US005407162A

United States Patent [19]

Manger

[11] Patent Number: 5,407,162

[45] Date of Patent: Apr. 18, 1995

[54] ARCHED WINDOW OR ARCHED DOOR DRAPERY-MOUNTING KIT

[76] Inventor: Gerald H. Manger, 71 Prospect St., Bernardsville, N.J. 07924

[21] Appl. No.: 112,932

[22] Filed: Aug. 30, 1993

[51] Int. Cl.[6] ..... A47H 1/14

[52] U.S. Cl. ..... 248/251; 160/330

[58] Field of Search ..... 248/263, 206.5, 261, 248/262, 251; 211/105.3; 160/84.1 R, 372, 330, 134

[56] References Cited

U.S. PATENT DOCUMENTS

| | | | |
|---|---|---|---|
| 2,562,836 | 7/1951 | Veschio | 211/105.3 X |
| 2,639,930 | 5/1953 | Thornton | 211/105.3 X |
| 2,790,558 | 4/1957 | Rosenbaum . | |
| 4,496,059 | 1/1985 | Leiter . | |
| 4,825,611 | 5/1989 | Bassett . | |
| 5,044,418 | 9/1991 | Donahue | 160/330 |
| 5,063,985 | 11/1991 | Bozzo | 160/134 X |
| 5,159,966 | 11/1992 | Fleishman | 160/84.1 R |
| 5,219,409 | 6/1993 | Lloyd | 160/330 |
| 5,295,595 | 3/1994 | Gobidas | 160/330 X |

*Primary Examiner*—J. Franklin Foss

*Attorney, Agent, or Firm*—William T. Hough

[57] ABSTRACT

Two separate tubular elbows are each mountable on upright inward upright surfaces below an arch of an arched door or arched window, with a free open-end of each tubular elbow directed upwardly toward the arch. One end of a plastic tube of polyvinyl chloride is detachably mounted rigidly within the open-end of of one of the tubular elbows, and an opposite end of the plastic tube is detachably mounted rigidly within the open-end of the other remaining one of the two separate tubular elbows. Between the spaced-apart mounted ends of the plastic tube, an intermediate portion thereof is bent into a bow-shape corresponding the approximate shape of a lower surface of the upwardly located arched door frame or window frame. Mounted thereabove on the upwardly located lower surface of the arched door frame is a downwardly extending rod support member having downwardly-extending opposite and spaced-apart opposing flexible clasp arms biased toward one-another sufficiently to snap and retain therebetween the intermediate portion of the plastic tube after the drape has been mounted and suspended from the plastic tube.

8 Claims, 2 Drawing Sheets

ARCHED WINDOW OR ARCHED DOOR DRAPERY-MOUNTING KIT

THE SPECIFICATION

This invention is directed to a combination device for mounting upper ends of drapes in a position corresponding to the shape of the arch of an arched window or arched door.

PRIOR ART

A patentability search conducted in Class 211, subclasses 105.1, 105.2 and 105.3 failed to reveal any analagous and/or relevant prior art patents, patents of interest being: a) a horizontal rod mounting combination of Basset U.S. Pat. No. 4,825,611 issued May 2, 1989 directed to a required horizontal rod for drape support, for use in an arched doorway; and 2) a transverse laterally bowed drapery slotted support device for a bay window, of Rosenbaum et al. U.S. Pat. No. 2,790,558; and 3) Leiter laterally sidewardly (and slightly-upwardly) bowed elongated device with opposite end mountings for displacing by pushing outwardly a drapery already above-supported along a straight horizontal line, of Leiter U.S. Pat. No. 4,496,059; and 4) adjustable for lengthening or shortening support for horizontally mounted curtains.

BACKGROUND TO THE INVENTION

Prior to the present invention, for the mounting of a drapery or drapery panels within an arch of an arched window or an arched doorway, there has not existed a suitable mounting combination device adequate for mounting particularly by the non-professional artisan, devoid of the complicated approaches and structures employed by the professionals. Also, heretofore, considerable skill and work effort was required to adapt the rod length and to provide adequate end and intermediate supports to arched windows and/or doors of varying widths, heights and degrees of curvature in the arches thereof. Such made it substantially impossible for the non-professional to properly achieve or perform such work, and increased to billing costs and work charges incurred when professionals were employed therefor.

OBJECTS

Accordingly, objects of the present invention include the overcoming and/or obviating of the foregoing problems and difficulties existing prior to the present invention.

More particularly, an object of the present invention is to provide a combination device for easy adjustment of rod length and for mounting typically on an undersurface of an arched window or door structure to conform to the particular window or door arch and to provide a professional aesthetic appearance and mounting in a neat and structurally sound and stable arrangement of support of downwardly suspended drape(s) and/or drape panel(s).

Another object is to provide an inexpensive way of achieving a curtain rod support that in an upwardly bowed state conforms to the architectural aperture (space) having crescent boundaries.

Another object is to enable easy installation over a normally substantially smooth arched downwardly-facing surface.

Another object is to enable for an arched window or door, an easy shortening and mounting of the drapery and/or drapery panel(s) so as to precisely or otherwise desirably fit the opening to the desired degree, within a short or brief mounting time even for the non-professional.

BROAD INVENTION

The invention is broadly and generically directed to an ached window downwardly-hanging drapery combination-device, which mounting device is devoid of inconsistent structures directed to horizontally-disposed drapery mounting rods. The novel combination device includes: a) two first rod-mounting structure(s) (and operative mechanism(s) thereof), b) at-least one second rod-supporting structure(s) (and operative mechanism(s) thereof), and (c) the upwardly-angled suspendable arched flexible curtain-rod member. The two first rod-mounting structure(s) is/are structured to provide for a rigid anchoring thereof on a substantially upright window frame or door frame surface below a window or door arch and each thereof for receiving and rigidly supporting a separate one of two opposite ends of an upwardly-angled suspendable arched flexible curtain-rod member. The one or more second rod-supporting structure(s) is/are structured to provide for a rigid anchoring it/them on an arcuate portion of an arched window or arched door. The one or more second rod-supporting structure(s) additionally is/are structured to provide for suspending an intermediate portion of an upwardly-angled suspended arched flexible curtain-rod having two opposite ends thereof mounted in spaced-apart mounted ones of the two first tube-mounting structure(s) (and operative mechanism(s) thereof). The upwardly-angled suspendable arched flexible curtain-rod member has above-noted the two opposite ends and the intermediate portion extending therebetween.

In a first preferred embodiment of the invention, each of the two first rod-mounting structure(s) includes a single upwardly-directed tubular receptacle receivable of one of the two opposite ends.

In a second preferred embodiment of the invention, as an improvement on the first preferred embodiment, each the single upwardly-directed tubular receptacle has inner tubular surfaces has a substantially circular shape and additionally each of the two opposite ends has an outer circumscribing surface having the substantially circular shape sufficiently circular that the outer circumscribing surface is rigidly and immovably insertable into and supportable by the inner tubular surfaces with the upwardly-angled suspendable arched flexible curtain-rod member.

In a third preferred embodiment, as an improvement on the second preferred embodiment, each of the inner tubular surfaces and the outer circumscribing surface is cylindrical in shape.

In a fourth preferred embodiment, as an improvement on the third preferred embodiment, for the aforestated combination, the two opposite ends and the intermediate portion are tubular in shape and construction thereof.

In a fifth preferred embodiment, as an improvement on the fourth preferred embodiment, the one or more one second rod-supporting structure(s) (and operative mechanism(s) thereof) includes a mounting base having opposite and spaced-apart opposing flexible clasp arms biased toward one-another to a predetermined degree sufficiently that the intermediate portion is pressable to a location and is intermittently retainable between the spaced-apart opposing flexible clasp arms.

In a sixth preferred embodiment, as an improvement on the fifth preferred embodiment, each of the opposite and spaced-apart opposing flexible clasp arms has a concave angular surface opposingly opposite and spaced from the concave angular surface of the other of the opposing flexible clasp arms, positioned in a predetermined alignment sufficiently that the intermediate portion is snapable and intermittently retainable between the opposing ones of the concave angular surfaces.

A seventh preferred embodiment corresponds to the fifth preferred embodiment, except as an improvement on the broad generic invention as above described.

An eighth preferred embodiment corresponds to the seventh preferred embodiment, except as an improvement on the seventh preferred embodiment.

In a ninth preferred embodiment as an improvement on the eighth preferred embodiment, the upwardly-angled suspendable arched flexible curtain-rod member is composed of a flexible plastic composition.

In a tenth preferred embodiment, as an improvement on the seventh preferred embodiment, the flexible plastic composition consists essentially of predominately polyvinyl chloride.

An eleventh preferred embodiment is the same as the ninth preferred embodiment, except as an improvement on the broad generic invention aforestated.

The invention may be better understood by making reference to the following Figures.

THE FIGURES

FIG. 1 diagrammatically illustrates symbollically an embodiment of the entire combination constituting the present invention, shown in perspective top and side exploded view with partial cut-aways.

FIG. 2 diagrammatically illustrates symbolically an upper mid-rod mounting element and parts thereof, of the same type illustrated as a part of FIG. 1, shown is a side cross-sectional exploded view but additionally illustrating each of opposite mounted ends of the passage positioned to accommodate amounting nail or the like.

FIG. 3 diagrammatically illustrates symbollically the same combination as that of FIG. 1, except having a plurality of the upper intermediate rod mounting elements of the same type illustrated in FIGS. 1 and/or 2. It is shown against a background in phantom showing the inward-face of a typical window or door arch and typical arch-mounted opposite (side-by-side) hanging drapes as they would appear when the arched rod member is threaded through an upper drape-suspending channel of each drape. Also, it is shown in a conventional tied-back drapes state.

DETAILED DESCRIPTION OF THE INVENTION

As to the illustrated embodiments of the foregoing Figures, the inventive combination may be described as follows.

Figure 1:
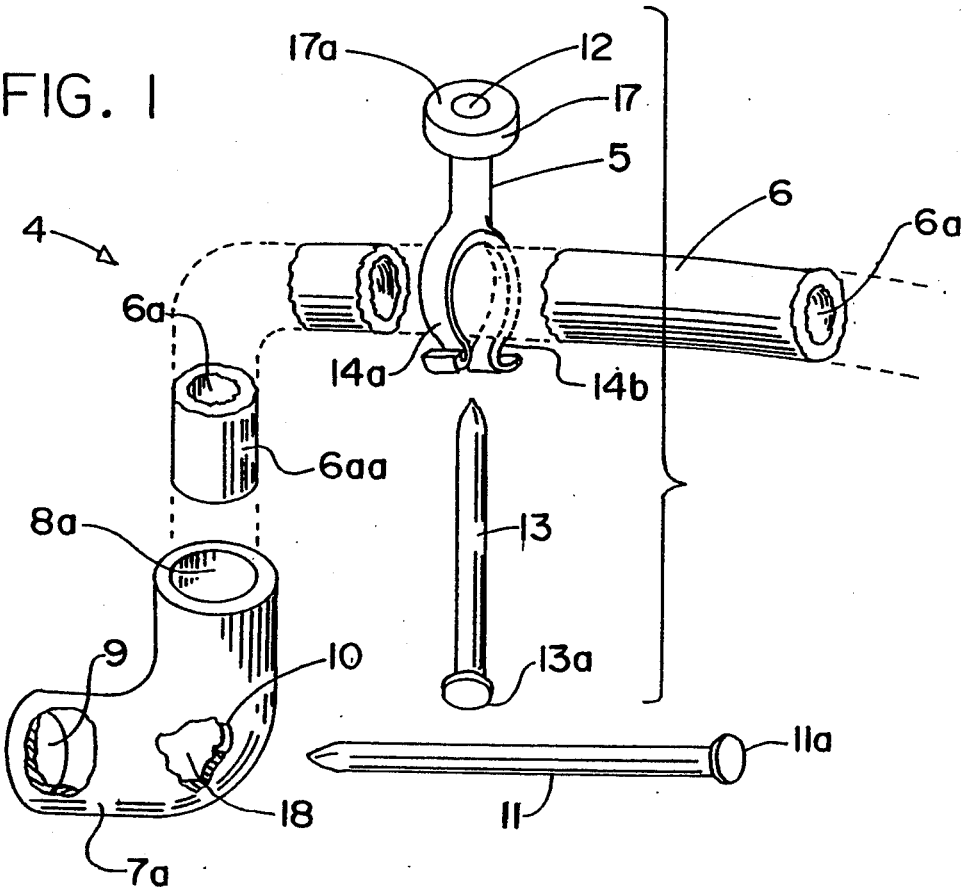

FIG. 1 diagrammatically illustrates symbollically an embodiment of the entire combination 4. The combination is shown and illustrated perspective top and side exploded view with partial cut-aways, in order to enable better understanding of the mechanism of operation of the various elements of the combination and the mounted state thereof. Illustrated elements and part or attributes thereof include the upper intermediate or mid-rod mounting element 5 that is mountable on an inside downwardly facing surface of an arch of an arched window and/or arched door. The intermediate or mid-rod mounting element 5 typically but not necessarily has a neck 6 and a flanged upper end that enable easy positioning the upper flat face 17*a* thereof against a typically flat under-face such as the downwardly-directed arch surface 15 (of FIG. 3). The intermediate and/or mid-rod mounting element 5 includes a shape that prevents the arched rod at its upper-positioned portion(s) from tending to swing or fall fowardly when supporting the weight of mounted drape(s) thereon; the illustrate embodiment of FIG. 1 illustrates a preferred shape having one-or more downwardly-extending arms 14*a* and 14*b*, preferaby as here the illustrated two opposing arms in the nature of a bracket or the illustrated clamp enabling illustrate snap-in mounting state of the rod 6 retainably therebetween. The other mounting element 5 completing the mounting use thereof, is typically the illustrated nail 13 insertable upwardly through lower opening 12*b* through channel 12*a* upwardly and through upper opening 12 from which it may be nailed into to the arched lower surface—such as lower surface 15 above-noted. Each of opposite ends 6*aa* and (FIG. 3) 6*bb* are typically mounted in opening(s) 8*a* and 8*b* of the tubular elbow-shaped tubular rod-end (s) of substantially right-angle bend therein, mounting element (s) 7*a* and/or 7*b;* however, it is equally with the scope of the invention to mount the upwardly-directed end(s) thereof, namely upwardly-directed end(s) 7*ax* and/or 7*bx* (of appropriate outer-diameter(s) within the through-space tubular channel 6*a* (of an appropriate inner diameter). When as illustrated the rod ends have mounting opening 8*a* and 8*b* above-described, the rod 6 optionally may be solid, i.e. devoid of through-space tubular channel 6*a,* and accordingly may also be of reduced ( smaller ) outside-diameter and circumference. As an obvious equivalent, a threaded screw may be substituted for the nail 13; however, preferably a nail 13 is utilized because it is believed to be more easily mounted as contrasted and compared to having to screw upwardly a screw into typically hard wood while holding the element 5. Whether a nail or screw, the illustrated nail head 13*a* is larger than the lower opening 12*b* and thereby is nailed upwardly sufficiantly to press upwardly against the lower surface 12*x*. Likewise, the tubular elbow-shaped tubular rod-end (s) has/have the nail-mounting space 18 connecting (in flow-communication with) the nail-receiving (or screw-receiving)opening (aperture) 10 and the opening 9, enabling insertion of nail 11 to be passed through the aperture 10 and nail-mounting space 18 and opening 9 when driving the nail into a laterally facing surface 15*a* (see FIG. 3); it is noted that this illustrated structure of element(s) 7*a* and 7*b* (FIG. 3) provide for significantly more secure mounting that resists tearing-away from the laterally-facing surface 15*a,* as contrasted to a perforated flange member to (for example) a solid member that alternatively might be utilized also as an equivalent element for the present combination. Elements 7*a* and 7*b* when nailed to the laterally-facing surface of the arch, is/are held by the nail heads 11' and 11" that has/have nail head diameter(s) larger than the diameter of hole 10.

Figure 2:
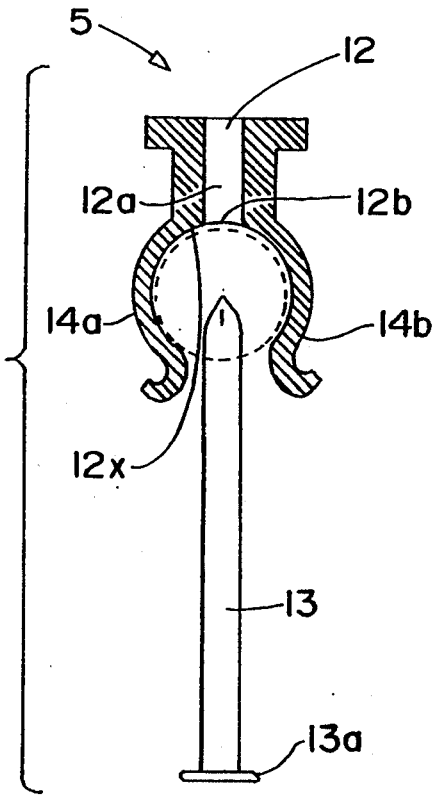

FIG. 2 illustrated a side cross-sectional view of the same element 5 as that of FIG. 1 in exploded view, illustrating the upper opening 12, the lower opening 12*b* and the interconnecting channel or passage 12*a,* and the combination element/nail 13 with its securing head 13*a*. This FIG. 2 also better illustrates the grasping shape of arms 14*a* and 14*b* and the position that the rod 6 occupies in the mounted state retainably between these clap-like bracket-shaped arms above-described. As aforestated, FIG. 2 diagrammatically illustrates symbolically an upper mid-rod mounting element and parts thereof, of the same type illustrated as a part of FIG. 1.

Figure 3:
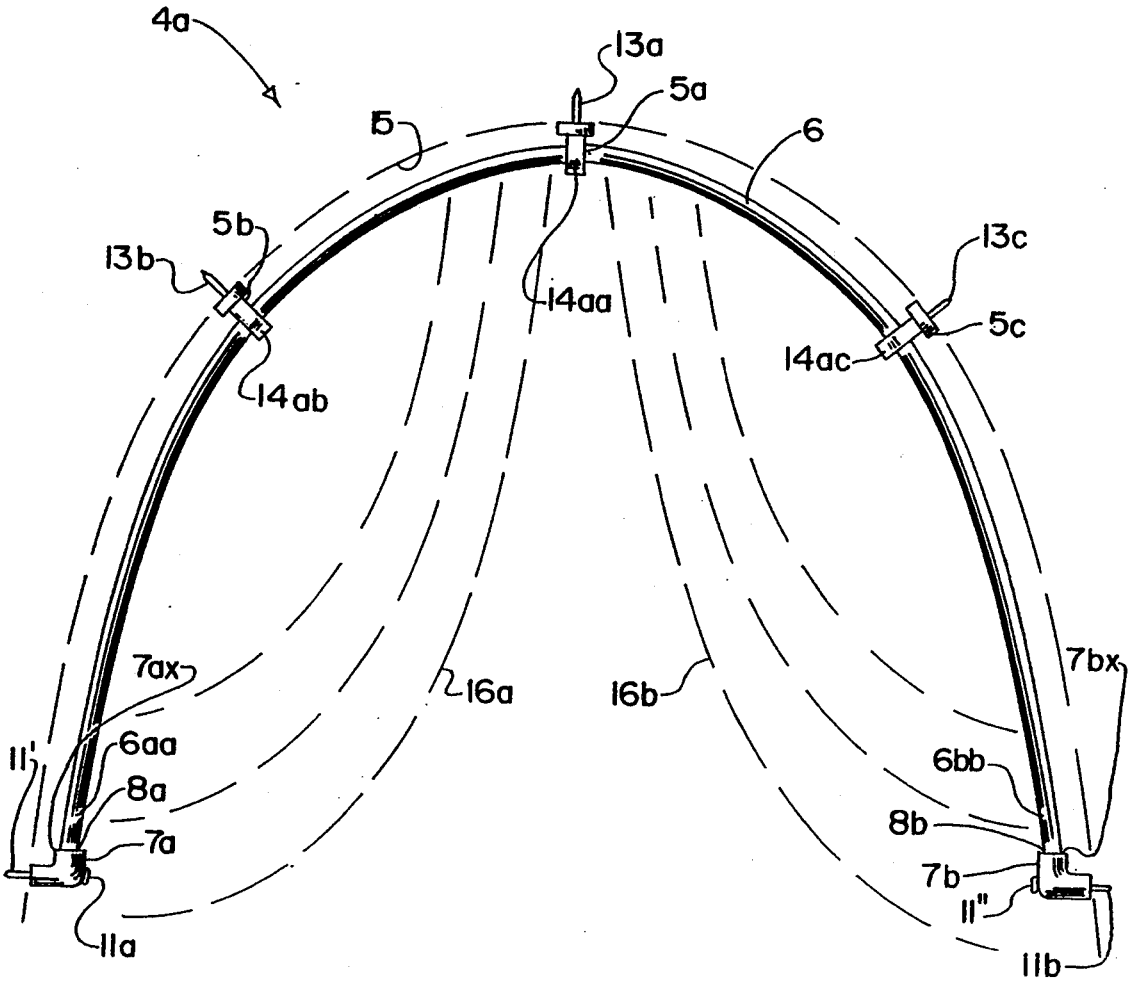

FIG. 3 diagrammatically illustrates symbollically a minor variation combination 4*a* as that of FIG. 1 combination 4, except FIG. 3 having (illustrating) a critically preferred plurality of the upper intermediate rod mounting elements of the same type illustrated in FIG. 2, shown against (also illustrating) a background in phantom showing the inward-face 15 and/or 15*a* of a typical window arch or door arch and typical arch-mounted opposite (side-by-side) hanging drapes as they would appear when the arched rod member 6 is threaded through an upper drape-suspending channel of each drape 161 and 16*b*, shown in a conventional tied-back state. The plurality of the illustrated elements 5*a*, 5*b* and 5*c* are critically preferred because of the fact that drapes are normally massive and/or heavy and would tend to distort the shape of the small rod 6 in its upwardly bowed position and state, significantly reducing any possibility of distorted appearance and/or of collapse and/or partial collapse by the rod falling or leaning forwardly or backward from it normally directly upwardly-bowed state and position. Also the FIG. 3 illustrates the opposite ends of the rod and the spaced-apart and opposite rod-end mounting elements 7*a* and 7*b* aforestated and described.

There may be major variations in the length of the rod, which preferably and normally is of light-weight synthetic plastic such as typically polyvinyl chloride and/or variations thereof, or of equivalent plastics which are substantially rigid but are sufficiently flexible in rod (solid or tubular) shape as to enable the critical bowing that is obviously critically essential to the afore illustrated invention. Tubular shaped construction is preferred for the present invention, for the rod, because of the greater strength of a rod having a larger (versus small) outside diameter and having a hollow interior (tubular) resulting in lighter rod (versus heavier weight of a solid rod). Another critical basis for the above-described plastic rod of a preferred embodiment, arises from the great ease (not difficult) of cutting-off unneeded length thereof for a particular arch of a window or door, enabling an inexperienced artisan or non-artisan to do the job easily without/devoid of expert help or assistance. Typical but not limited thereto, arches of windows or doors to which the present invention is typically utilized the upper arched portion extending upwardly about three to about four feet, opposite bottom portions of the arch space-apart up to about six feet. However, the invention clearly is not limited to such parameters, being adaptable to much small or much larger parameters. The plastic tubular polyvinylchloride rod typically ranges from 24 inches to about 10 feet or more, with the aforestated utility of having longer rods provided which may be easily adjusted to needed and required length. Also such plastic(s) as rods, may be easily fused by convention and/or well-known existing technology—not a part of this invention, except to the extent that such is available to fuse together such tubular plastic rods to result in a longer rod for purposes of the present invention if so-needed in a particular situation.

Typically a person would measure the length of the arch in which the drapes are to be suspended, in order to ascertain both the end-mounting positions (to be marked) and the length of the rod to be mounted therebetween. Depending upon the length of the rod required, the number of intermediate and/or mid-rod mounting element(s) 5 required or likely to be required for a particular drape(s) size and weight(s). After estimating the appropriate number to secure as aforestated, this/these mounting element(s) 5 is/are then positioned and mounted by driving the nail as aforestated, and likewise the oppositely positioned rod-end mounting elements 7*a* and 7*b* are appropriately mounted at the points previously marked, allowing slightly greater distance for the seating thereof, and to provide sufficient upward lift as to insure that the restraining arm(s) 14*a* and/or 14*b* will be engaged retainably with the rod when mounted. Thereupon, the nails 11*a* and 11*b* are driven-in by a hammer to secure the elements 71 and 7*b* at the proper aforestated locations. Thereafter, the rod is dismounted, threaded through the mounting channels at the tops of the drapes, and thereafter the rod is positioned withing the mounting elemen(s) 5—such as 5*a*, 5*b* and 5*c*, and mounted at the opposite ends in the rod-end mounting elements 71 and 7*b*.

It is within the scope and contemplation of the present invention, to make variations and/or substitution of equivalents and/or modifications, within the skill of an ordinary artisan.

I claim:

1. An arched window downwardly-hanging drapery device consisting essentially of: a) two first rod-mounting moans for a rigid anchoring thereof on a substantially upright window frame or door frame surface below a window or door arch and each thereof for receiving and rigidly supporting a separate one of two opposite ends of an upwardly-angled suspendable arched flexible curtain-rod member; b) at-least one second rod-supporting moans for a rigid anchoring thereof on an arcuate portion of an arched window or arched door and for suspending an intermediate portion of an upwardly-angled suspended arched flexible curtain-rod having two opposite ends thereof mounted in spaced-apart mounted ones of said two first tube-mounting means; and (c) said upwardly-angled suspendable arched flexible curtain-rod member having said two opposite ends and said intermediate portion, each of said two first rod-mounting moans having an upwardly directed tubular receptacle structure receivable of a separate one of said two opposite ends in a supported upward direction, such that the two first rod-mounting means and said at-least one second rod-supporting means cummulatively support said intermediate portion in an upright position and such that said arched portion is anchorable on said arcuate portion.

2. The arched window downwardly-hanging drapery device of claim 1, in which each said single upwardly-directed tubular receptacle has inner tubular surfaces having a substantially circular shape and in which each of said two opposite ends has an outer circumscribing surface having said substantially circular shape sufficiently that said outer circumscribing surface is rigidly and immovably insertable into and supportable by said inner tubular surfaces with said upwardly-angled suspendable arched flexible curtain-rod member.

3. The arched window downwardly-hanging drapery device of claim 2, in which each of said inner tubular surfaces and said outer circumscribing surface is cylindrical in shape.

4. An arched window downwardly-hanging drapery device consisting essentially of: a) two first rod-mounting means for a rigid anchoring thereof on a substantially upright window frame or door frame surface below a window or door arch and each thereof for receiving and rigidly supporting a separate one of two opposite ends of an upwardly-angled suspendable arched flexible curtain-rod member; b) at-least one second rod-supporting means for a rigid anchoring thereof on an arcuate portion of an arched window or arched door and for suspending an intermediate portion of an upwardly-angled suspended arched flexible curtain-rod having two opposite ends thereof mounted in spaced-apart mounted ones of said two first tube-mounting means; and (c) said upwardly-angled suspendable arched flexible curtain-rod member having said two opposite ends and said intermediate portion, said at-least one second rod-supporting means including a mounting base having opposite and spaced-apart opposing flexible clasp arms biased toward one-another to a predetermined degree sufficient that said intermediate portion is pressable to a location and is intermittently retainable between said spaced-apart opposing flexible clasp arms.

5. The arched window downwardly-hanging drapery device of claim 4, in which each of said opposite and spaced-apart opposing flexible clasp arms has a concave angular surface opposingly opposite and spaced from the concave angular surface of the other of the opposing flexible clasp arms, positioned in a predetermined alignment sufficient that said intermediate portion is snapable and intermittently retainable between said opposing ones of said concave angular surfaces.

6. The arched window downwardly-hanging drapery device of claim 4, in which said upwardly-angled suspendable arched flexible curtain-rod member is composed of a flexible plastic composition.

7. The arched window downwardly-hanging drapery device of claim 4, in which said flexible plastic composition consists essentially of predominately polyvinyl chloride.

8. An arched window downwardly-hanging drapery device consisting essentially of: a) two first rod-mounting means for a rigid anchoring thereof on a substantially upright window frame or door frame surface below a window or door arch and each thereof for receiving and rigidly supporting a separate one of two opposite ends of an upwardly-angled suspendable arched flexible curtain-rod member; b) at-least one second rod-supporting means for a rigid anchoring thereof on an arcuate portion of an arched window or arched door and for suspending an intermediate portion of an upwardly-angled suspended arched flexible curtain-rod having two opposite ends thereof mounted in spaced-apart mounted ones of said two first tube-mounting means; and (c) said upwardly-angled suspendable arched flexible curtain-rod member having said two opposite ends and said intermediate portion, in which said upwardly-angled suspendable arched flexible curtain-rod member is composed of a flexible plastic composition.

* * * * *